United States Patent [19]

Sivachenko et al.

[11] Patent Number: 4,827,455

[45] Date of Patent: May 2, 1989

[54] MIXER

[75] Inventors: Leonid A. Sivachenko, Mogilev; Vladilen I. Balovnev, Moscow; Jury V. Surovegin, Mogilev; Alexei N. Maximenko, Mogilev; Vladimir V. Moiseenko, Mogilev; Nikolai N. Gobralev, Mogilev, all of U.S.S.R.

[73] Assignee: Mogilevsky Mashinostroitelny Institut, Mogilev, U.S.S.R.

[21] Appl. No.: 826,192

[22] Filed: Feb. 5, 1986

[51] Int. Cl.[4] ..... B01F 7/08; B28C 5/12

[52] U.S. Cl. ..... 366/292; 366/66; 366/296; 366/320

[58] Field of Search ..... 366/279, 292, 320, 326, 366/349, 117, 118, 297, 298, 300, 64, 65, 66, 294, 293, 296; 416/227, 76

[56] References Cited

U.S. PATENT DOCUMENTS

| | | | |
|---|---|---|---|
| 2,641,412 | 6/1953 | Byberg | 366/326 X |
| 2,733,900 | 2/1956 | Wobensmith | 416/76 |
| 3,185,451 | 5/1965 | Snyder | 366/66 |

FOREIGN PATENT DOCUMENTS

| | | | |
|---|---|---|---|
| 903131 | 2/1982 | U.S.S.R. . | |
| 919892 | 4/1982 | U.S.S.R. | 366/64 |
| 1000284 | 3/1983 | U.S.S.R. | 366/54 |

*Primary Examiner*—Harvey C. Hornsby
*Assistant Examiner*—Scott L. Haugland
*Attorney, Agent, or Firm*—Ladas & Parry

[57] ABSTRACT

A mixer comprises a housing having charging and discharge pipes, and arcuate working members fashioned as rods coiled to form cylindrical springs and attached by ends thereof to drive shafts. The working members are disposed inside the housing one above the other, the upper working member having a diameter substantially less than the diameter of the lower working member, the working members being coiled in the opposite directions.

13 Claims, 6 Drawing Sheets

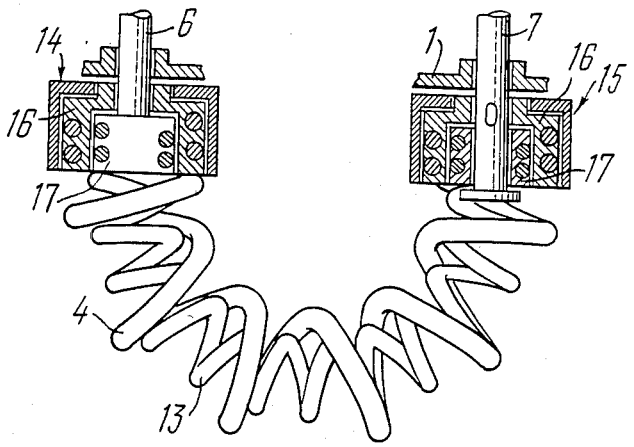
FIG. 3
FIG. 4
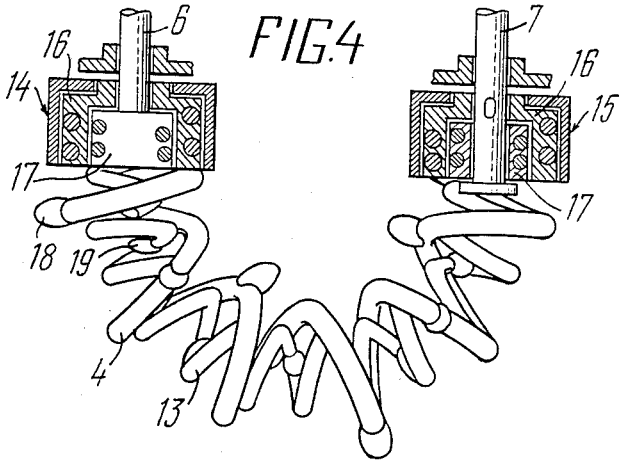

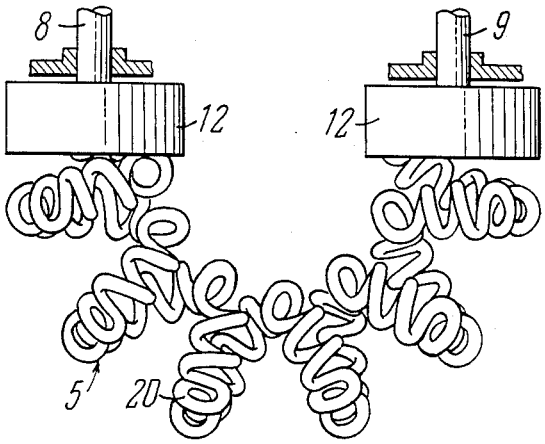
FIG. 7
FIG. 8
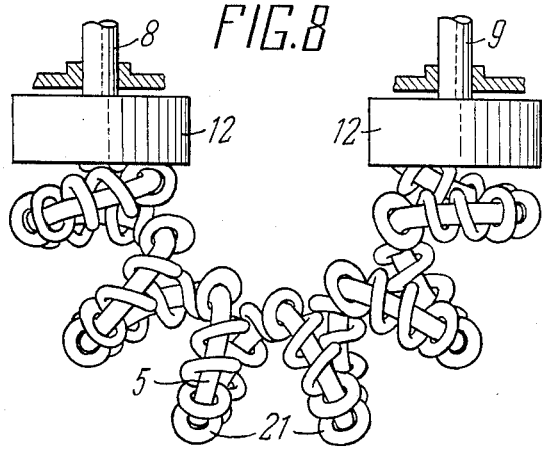

MIXER

This invention relates to equipment associated with the art of construction, and more particularly to mixers for the preparation of compositions and slurries. Such mixers may find utilization in civil engineering, in the fabrication of building materials, in the chemical and food industries and for other applications.

There are widely known mixers normally comprising a housing having charging and discharge ports or pipes, and a working member. Used as the working members are generally arcuate flexible shafts or blade stirrers connected to a drive means through a two-stage gear-and-lever train, a drive shaft and a system of toothed wheels.

However, such mixers are structurally overcomplicated due to a large number of moving parts employed, while their working members are susceptible to quick wear caused by heavy loads especially imposed by construction needs.

Also known is a mixer (cf. USSR Inventor's Certificate No. 903-131, IPC B 28 C 5/16) comprising a housing having charging and discharge ports, and arcuate working members fashioned as rods coiled to form cylindrical springs and attached by their ends to drive shafts.

In this mixer the working members thereof are arranged in one row lengthwise of the housing.

Inherent in the aforedescribed mixer construction is a disadvantage residing in that mixing is not sufficiently vigorous in such an arrangement of the cylindrical springs due to relatively few areas of active stirring of the materials being mixed and because of stagnation zones tending to form above the working member.

It is therefore an object of this invention to make mixing more vigorous.

The object is attained by that in a mixer comprising a housing having charging and discharge pipes, and disposed inside the housing arcuate working members fashioned as rods coiled to form cylindrical springs and affixed by their ends to drive shafts, according to the invention, the working members are positioned inside the housing one above the other, each successive overlying working member having a diameter which is substantially less than the diameter of the adjacent underlying working member, the working member being coiled in the opposite directions. The working members may be arranged concentrically in one plane one above the other or, alternatively, they may be arranged one above the other in mutually perpendicular planes.

Such embodiment of the working members and arrangement thereof one relative to the other enable to provide active turbulent flows of materials being mixed throughout the interior of the mixer, the flows tending to entrain even large-size particles of the materials being mixed from the bottom of the mixer to maintain them in a suspended state in the zone of active stirring. As a result, all the particles of the materials are wedged and compressed by the side surfaces of the coiled working members to be thoroughly crushed or reduced in size which improves the quality of the final mix.

According to the invention, attachments of the working members to the drive shafts are arranged at an angle relative to the axes of the drive shafts, the vertices of inclination angles of the attachments facing one side. In consequence, the working members execute complex three-dimensional motions to actively stir components being mixed accompanied by vibromixing at a frequency of induced oscillations substantially equal to the rate of rotation of the drive shafts.

Preferably, disposed inside the working member of larger diameter is an additional working member the coils of which are wound in a direction opposite to that of the coils of the main working member, the additional working member being capable of rotating in a direction counter to the direction of rotation of the main working member. Therewith, in order to assure that the main working member and the additional working member rotate in the opposite directions, attachments thereof to the drive shafts are formed by two bearings journaled one inside the other; in one of the attachments the outer bearing being capable of free rotation about the first drive shaft and connected to an end of the main working member, the inner bearing being fixedly secured on the first drive shaft and connected to an end of the additional working member, whereas in another attachment the outer bearing is connected to the other end of the working member and fixedly secured to the second drive shaft, the inner bearing being connected to the other end of the additional working member to be capable of rotating about the second drive shaft.

Such an arrangement of the working members makes it possible to invigorate stirring thanks to increasing the number of active stirring zones determined by the formation of counterflows of the materials being mixed resulting in greater turbulence involving greater masses of the materials being mixed to be stirred.

Advisably, both the main and the additional working members are provided with blades arranged correspondingly on the outer and inner sides of the working members, the blades of the working members being disposed in a mutually perpendicular relationship. This eliminates stagnation zones, speeds up mixing and improves the quality of the final mix.

Alternatively, at least one of the working members is defined by a cylindrical spring having a diameter substantially less than the diameter of coils of this working member.

Also, at least one of the working members is preferably composite or made up of separate interconnected sections, the adjoining sections being coiled in the opposite directions. This enables to further invigorate stirring through the provision of a multiplicity of counterflows of the materials being mixed produced by such a working member.

According to another aspect of the invention, the coils of the working members may be of elliptical or multihedral configuration which imparts greater rigidity to the working members.

Alternatively, the coils of the working members may be U-shaped or rectangular in cross-sections which also adds rigidity to the working members.

In view of the foregoing, mixers featuring working members embodied and arranged as have been described make it possible to invirate stirring, improve the quality of the final mix, and improve the conditions for servicing and fabricating such mixers.

The invention will now be described in greater detail with reference to specific preferred embodiments thereof taken in conjunction with the accompanying drawings, in which:

FIG. 3 illustrates an alternative arrangement of one of the working members provided with an additional working member;

FIG. 4 shows the manner in which blades are arranged on the main and additional working membrane;

FIG. 7 shows an alternative modification of one of the working members;

FIG. 8 is one more modified form of one of the working members;

Figure 2:
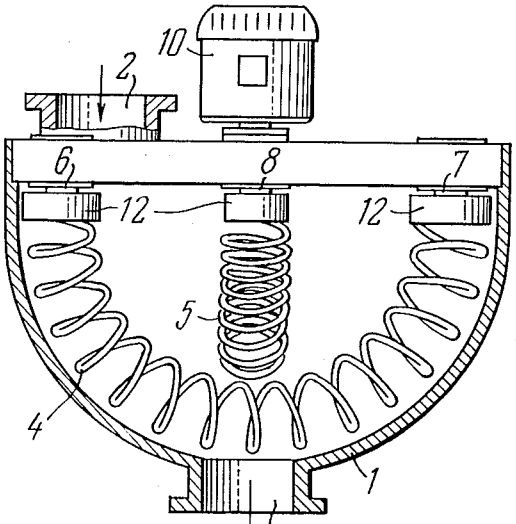
FIG. 2 is a view of the mixer embodying the present invention wherein the working members are arranged in mutually perpendicular planes.

A mixer comprises a housing 1 (FIGS. 1 and 2) having charge and discharge pipes 2 and 3, respectively, and arcuate working members 4 and 5 accommodated inside the housing 1 and fashioned as rods coiled to form cylindrical springs. The working members 4 and 5 are attached by their ends to drive shafts 6, 7 and 8, 9, respectively.

The shafts 6, 7, 8 and 9 are driven by a drive means mounted on the housing 1 and comprised of any known suitable mechanisms, such as an electric motor 10, and a reducer 11 connected to the shafts 6, 7, 8 and 9.

Figure 1:
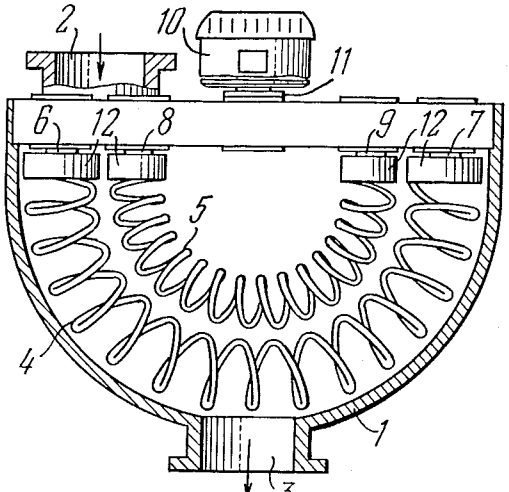
FIG. 1 shows a mixer according to the invention with concentrically arranged working members.

The charging pipe 2 may be disposed in the central portion of the housing 1 as shown in FIGS. 3 to 8, or at the peripheral portion thereof as seen best in FIGS. 1 and 2.

The working members 4 and 5 are positioned in the housing 1 one above the other, the cylindrical springs making up the working members 4 and 5 being of different diameters, the spring of the upper working member 5 having a diameter essentially smaller than that of the lower working member 4, the springs of the working members being coiled in the opposite directions.

The working members 4 and 5 may be mounted one above the other in one plane as shown in FIG. 1, or in mutually perpendicular planes as illustrated in FIG. 2.

Figure 5:
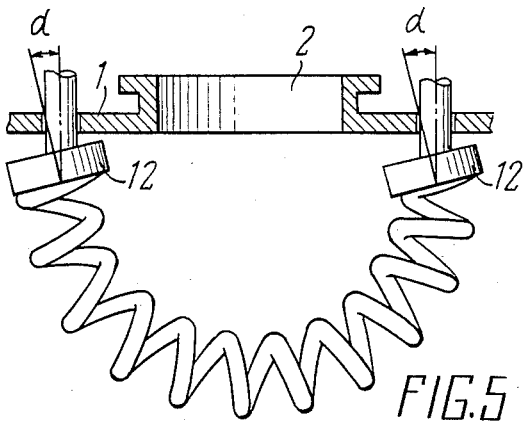
FIG. 5 illustrates the arrangement of attachment of the working members at an angle to the axes of the drive shafts (exemplified by only one of the working members)
Figure 6:
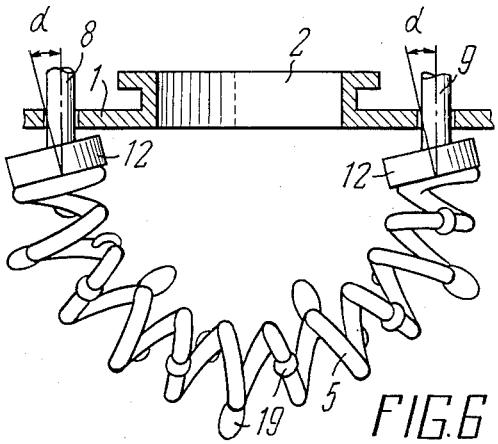
FIG. 6 illustrates an arrangement essentially similar to that shown in FIG. 5 with blades secured on the working member.

Elements 12 for attachment of the working members 4 and 5 to the drive shafts 6, 7 and 8, 9 are fashioned in any known suitable manner to be disposed either in one horizontal plane as seen in FIGS. 1 and 2, or positioned at an angle $\alpha$ relative to the axes of the drive shafts as shown in FIGS. 5 and 6.

According to FIGS. 5 and 6, vertices of inclination angles of the attachments 12 relative to the axes of the drive shafts face toward one side.

Alternatively, the working member 4 (FIGS. 3 and 4) of larger diameter may have arranged thereinside an additional working member 13 in the form of a rod coiled to form a cylindrical spring. The additional working member 13 is coiled in a direction opposite to the direction in which the main working member 4 is coiled. Further, the additional working member 13 is capable of rotating in a direction opposite to the one in which the main working member 4 rotates.

In order to make the main working member 4 and the additional member 13 rotate in the opposite directions, attachments 14 and 15 by means of which they are secured to the drive shafts 6 and 7 are defined by two sliding bearings 16 and 17, respectively, journaled one inside the other.

In the attachment 14 the outer bearing 16 is rotatably mounted on the drive shaft 6 and connected to one end of the main working member 4, the inner bearing 17 being fixedly secured to the drive shaft 6 and connected to one end of the additional working member 13.

In the attachment 15 the outer bearing 16 is connected to the other end of the main working member 4 and fixedly secured on the drive shaft 7, the inner bearing 17 being connected to the other end of the additional working member 13 to be freely rotatable about the drive shaft 7.

With reference to FIG. 4 the main and additional working members 4 and 13 are provided with blades 18 and 19, respectively. The blades 18 are arranged on the outer periphery of the main working member 4. The blades 19 are arranged on the inner periphery of the additional working member 13. The blades 18 and 19 of the working members 4 and 13 are disposed in a mutually perpendicular relationship.

If necessary, the blades 19 may be arranged on the working members 4 or 5 in the manner shown in FIG. 6.

Used as rods of the working members 4 or 5 are cylindrical spring 20 having a rod diameter substantially less than the coiling diameter of this working member as seen best in FIG. 5; each of the working members 4 or 5 may be wound around by a cylindrical spring 21 as shown in FIG. 8.

Figure 9:
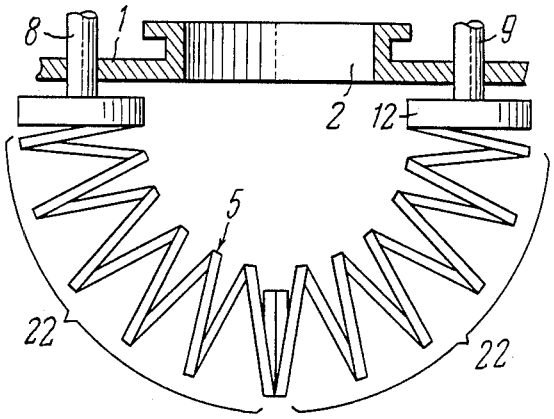
FIG. 9 illustrates a composite or sectional arrangement of the working members.

With reference to FIG. 9, the working members 4 and 5, or one of the working members 4 or 5 may be of composite or multi-piece construction made up of interconnected sections 22, the sections being interconnected by any known suitable means, such as bolts, the adjoining sections 22 being coiled in the opposite directions. This arrangement of the working members allows to facilitate repairs by making it possible to promptly replace worn sections and thereby to extend the service life of the mixer. In addition, it affords to make use of such mixers for preparation of compositions and slurries from a wide range of initial materials.

Figure 10:
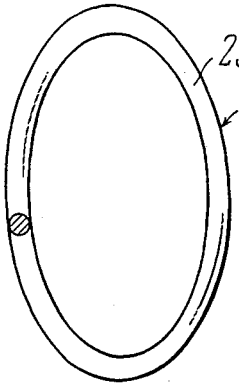
FIGS. 10, 11 and 12 are various shapes in which the working members are coiled.
Figure 11:
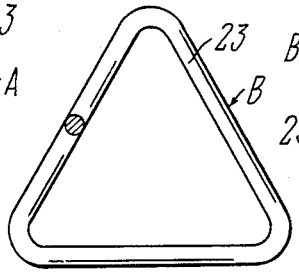
Figure 12:
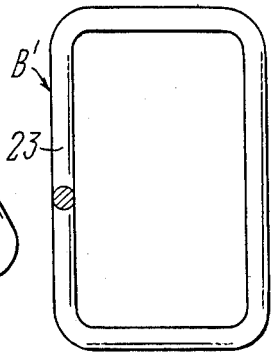

As has been mentioned earlier, each of the working members 4 and 5 is coiled in the form of an essentially cylindrical spring, coils 23 thereof having elliptical shape as indicated generally by A in FIG. 10, or be multihedral, particularly triangular, as indicated by B in FIG. 11, or have rectangular shape as indicated by B, in FIG. 12.

Figure 13:
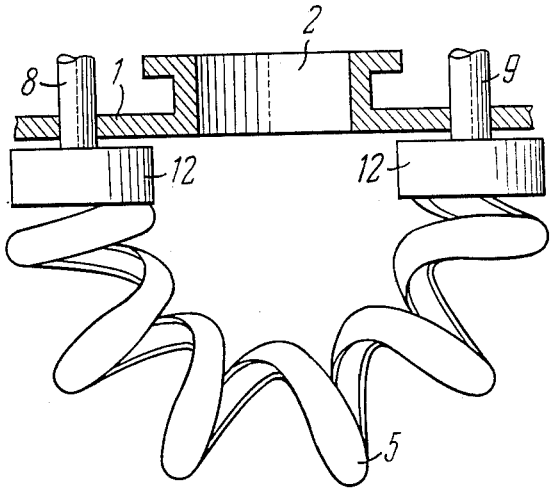
FIG. 13 illustrates a rod-like arrangement of the working member, the rod being U-shaped in cross-section.
Figure 14:
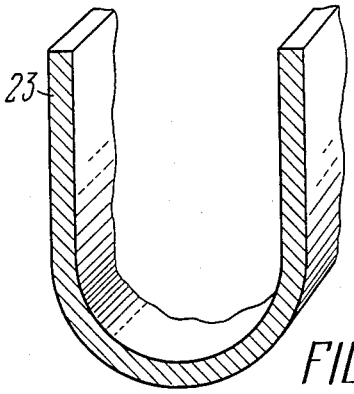
FIG. 14 is a cross-section of the working member as shown in FIG. 13.
Figure 15:
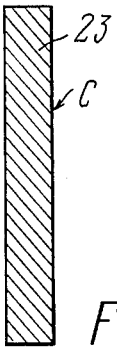
FIG. 15 is a rod-like working member of essentially rectangular cross-section.

The coils 23 of the working members 4 and 5 may be round in cross-section as shown in FIGS. 10 to 12 or, alternatively, they may be U-shaped in cross-section faced by the interior of the U toward the centerline of the working member, as best seen in FIGS. 13 and 14; or alternatively, they may be rectangular in cross-section as indicated by C in FIG. 15.

The aforedescribed shapes of the working members are advantageous in that they relieve stresses in the working members thanks to reducing the moment of resistance of the coil cross-section relative to axes perpendicular to the longitudinal centerline of the working member and improve torsional rigidity of the working members.

The mixer according to the invention operates in the following manner.

Initial materials to be mixed are fed through the charging pipe 2 into the housing 1 (FIGS. 1 and 2) of the mixer. The working members 4 and 5 are rotated by the electric motor 10 whereby thanks to the opposite coiling direction of the working members and different diameters thereof the initial materials charged into the mixer are actively stirred to form a multiplicity of counterflows in the interior of the housing 1 of the mixer. The positioning of the working members one above the other prevents large size fractions of the materials being mixed from accumulating at the bottom of the housing 1, since these are continuously maintained in a suspended state under the action of the working members and are crushed thereby in the corners of rotation of the working members.

When the working members 4, 5 and 13 are attached and arranged as shown in FIGS. 3 to 15, they execute a complex three-dimensional motion to actively stir the mixture components. Also, stirring is augmented by the vibration of the working members at a frequency of induced oscillations equal to the rate of rotation of the drive shafts, whereby stagnation is avoided in the center of the housing of the mixer to result in better mixing.

The mixed product is discharged through the discharge pipe 3.

What is claimed is:

1. A mixer comprising:

a housing;

a charging pipe arranged in said housing;

a discharge pipe arranged in said housing;

at least two arcuate working members disposed inside said housing and fashioned as rods coiled to form cylindrical springs and the springs bent such that their axes describe arcs;

drive shafts mounted in said housing;

attachments securing said working members by their ends to said drive shafts;

said working members being positioned inside said housing directly above one another, the uppermost working member having a diameter substantially less than the diameter of the lowermost working member, said working members being alternately coiled in opposite directions.

2. A mixer as defined in claim 1, wherein said working members are arranged concentrically about a centerline of said housing and in one plane above one another.

3. A mixer as defined in claim 2, wherein said attachments of said working members to said drive shafts are arranged at an oblique angle relative to the axes of said drive shafts so that said attachments are angled in the same directions.

4. A mixer as defined in claim 2 wherein coils of said working members are elliptical or multihedral.

5. A mixer as defined in claim 2 wherein coils of said working members are U-shaped in cross-section, the interior of the U facing the longitudinal centerlines of said working members.

6. A mixer as defined in claim 1 wherein said working members are disposed above one another in alternate mutually perpendicular planes.

7. A mixer as defined in claim 1 wherein there is provided an additional working member; said additional working member being disposed inside said lowermost working member, said additional working member having a coiling direction opposite to that of said lowermost working member and being capable of rotation in a direction opposite to the direction of rotation of said lowermost working member; the mixer being further provided with means for rotating said lowermost and additional working members in opposite directions.

8. A mixer as defined in claim 7 wherein said means for rotating said lowermost and additional working members in the opposite directions is defined by attachment pairs comprising the attachments of the lowermost working member and additional attachments securing the additional working member by its ends to said drive shafts, each of said attachment pairs being formed by bearings journaled one inside the other, in one of said attachment pairs the outer bearing being capable of free rotation about a first one of the drive shafts and connected to one end of said lowermost working member, the inner bearing being fixedly secured on the first drive shaft and connected to one end of said additional working member, whereas in another of said attachment pairs the outer bearing is connected to the other end of said lowermost working member and fixedly secured to a second one of the drive shafts, the inner bearing being connected to the other end of said additional working member and capable of freely rotating about the second drive shaft.

9. A mixer as defined in claim 7 wherein blades are provided; said blades being affixed to said lowermost and additional working members on the outer and inner sides thereof, respectively, said blades of said working members being arranged in a mutually perpendicular relationship.

10. A mixer as defined in claim 1 wherein the rod forming at least one of said working members has a diameter substantially less than the coiling diameter of this working member.

11. A mixer as defined in claim 1 wherein at least one of said working members is composite or made up of separate interconnected sections, the adjoining sections being coiled in opposite directions.

12. A mixer as defined in claim 11 wherein coils of said working member are rectangular in cross-section.

13. A mixer comprising:

a housing;

a charging pipe arranged in said housing;

a discharging pipe arranged in said housing;

first and second arcuate working members disposed inside said housing and fashioned as rods coiled to form cylindrical springs and the springs bent such that their axes describe arcs;

first and second pairs of shafts mounted in said housing; at least one of each of said pairs being a drive shaft;

said first and second working members being secured by their ends to said first and second pairs of shafts respectively by means of attachments;

said first working member being positioned inside the arc formed by said second working member and having a diameter substantially less than the diameter of said second working member, said first and second working members being coiled in the opposite directions.

* * * * *